United States Patent [19]

Barnes, Jr. et al.

[11] 4,158,832

[45] Jun. 19, 1979

[54] SEISMIC APPARATUS FOR DISCRIMINATION BETWEEN TRACK-TYPE VEHICLES AND WHEEL-TYPE VEHICLES

[75] Inventors: Roswell P. Barnes, Jr., Providence, R.I.; Glenn E. Fellows, Weston, Mass.

[73] Assignee: The United States of America as represented by the Secretary of the Army, Washington, D.C.

[21] Appl. No.: 118,205

[22] Filed: Jun. 19, 1961

[51] Int. Cl.[2] ..... G08G 1/00

[52] U.S. Cl. ..... 340/38 S; 340/15; 340/38 R; 340/566

[58] Field of Search ..... 340/15, 17, 258 D, 261, 340/15.5 C, 31 R, 38 R, 385, 566; 343/8, 9; 181/0.52, 0.53

[56] References Cited

U.S. PATENT DOCUMENTS

| | | | |
|---|---|---|---|
| 2,679,746 | 6/1954 | De Boisblanc | 340/566 |
| 2,820,361 | 1/1958 | Apps | 340/566 |
| 2,942,247 | 6/1960 | Lienau et al. | 340/15 |
| 3,049,699 | 8/1962 | Larrick et al. | 340/566 |
| 3,109,165 | 10/1963 | Bagno | 340/566 |
| 3,111,186 | 11/1963 | Schroeder | 181/0.5 |

*Primary Examiner*—Nelson Moskowitz
*Attorney, Agent, or Firm*—Nathan Edelberg; Robert P. Gibson; Jeremiah G. Murray

EXEMPLARY CLAIM

10. A vehicle identifying circuit comprising: means for detecting seismic vibrations created by passing vehicles and converting them into electrical impulses; frequency-sensing circuit means coupled to said detecting means for producing electrical signals in accordance with the frequency characteristics of said impulses, said frequency-sensing circuit means comprising an amplifier, a clipper circuit, a differentiator circuit, a rectifier and an integrator coupled in sequence to produce said electrical signals; and vehicle discriminating circuit means coupled to said frequency-sensing means to convert said signals into output pulses having voltage levels indicative of the character of the suspension system of the passing vehicle.

13 Claims, 2 Drawing Figures

SEISMIC APPARATUS FOR DISCRIMINATION BETWEEN TRACK-TYPE VEHICLES AND WHEEL-TYPE VEHICLES

This invention relates to signal discriminators and more specifically to a method and apparatus for identifying the generating sources of similar electric signals.

A moving object such as a truck will generate a characteristic noise signal in a conventional seismic detector. Since this noise signal is peculiar to the originating source, it is herein referred to as its "signature."

It is an object of this invention to automatically identify the signature generating source by its signature.

It is a more specific object to determine whether the signature-producing source is a vehicle traveling on wheels or on treads.

In military intelligence operations it is often necessary to identify and to evaluate the nature of vehicular activity in enemy regions. It is particularly important to know how many tanks and how many trucks pass a given region per unit of time. There is, therefore, a pressing need for a device capable of reliably identifying and counting passing tanks and trucks.

The electric signal, or signature, which a moving vehicle generates in a seismic detector is peculiar to the mechanical structure of the vehicle. The greater the similarity between vehicles, the greater will be the resemblance between their signatures. The conventional methods for identifying vehicular traffic by its signatures have been found to be unreliable in distinguishing between vehicles traveling on wheels, herein called "trucks," and vehicles traveling on treads, herein denoted as "tanks."

Our method makes use of the fact that the major portion of the energy in the seismic signal from a tank, or other treaded vehicle, is due to the individual treads hitting the surface of the road. This signal will thus have a strong frequency component corresponding to the repetition rate at which the treads contact the road surface. For an M-47 medium tank, for instance, this frequency, in cycles per second, was found to be approximately 2.6 times the tank speed in miles-per-hour.

On the other hand, a truck or other vehicle on tires has no corresponding mechanism for generating a strong single frequency component, so that a frequency meter will fluctuate rapidly in a random manner for a truck signal. Thus a device constructed for measuring the frequency fluctuations of a received intrusion signal will indicate large fluctuations for trucks or cars and small fluctuations for tanks, half-tracks or other crawler-type vehicles.

Figure 1:
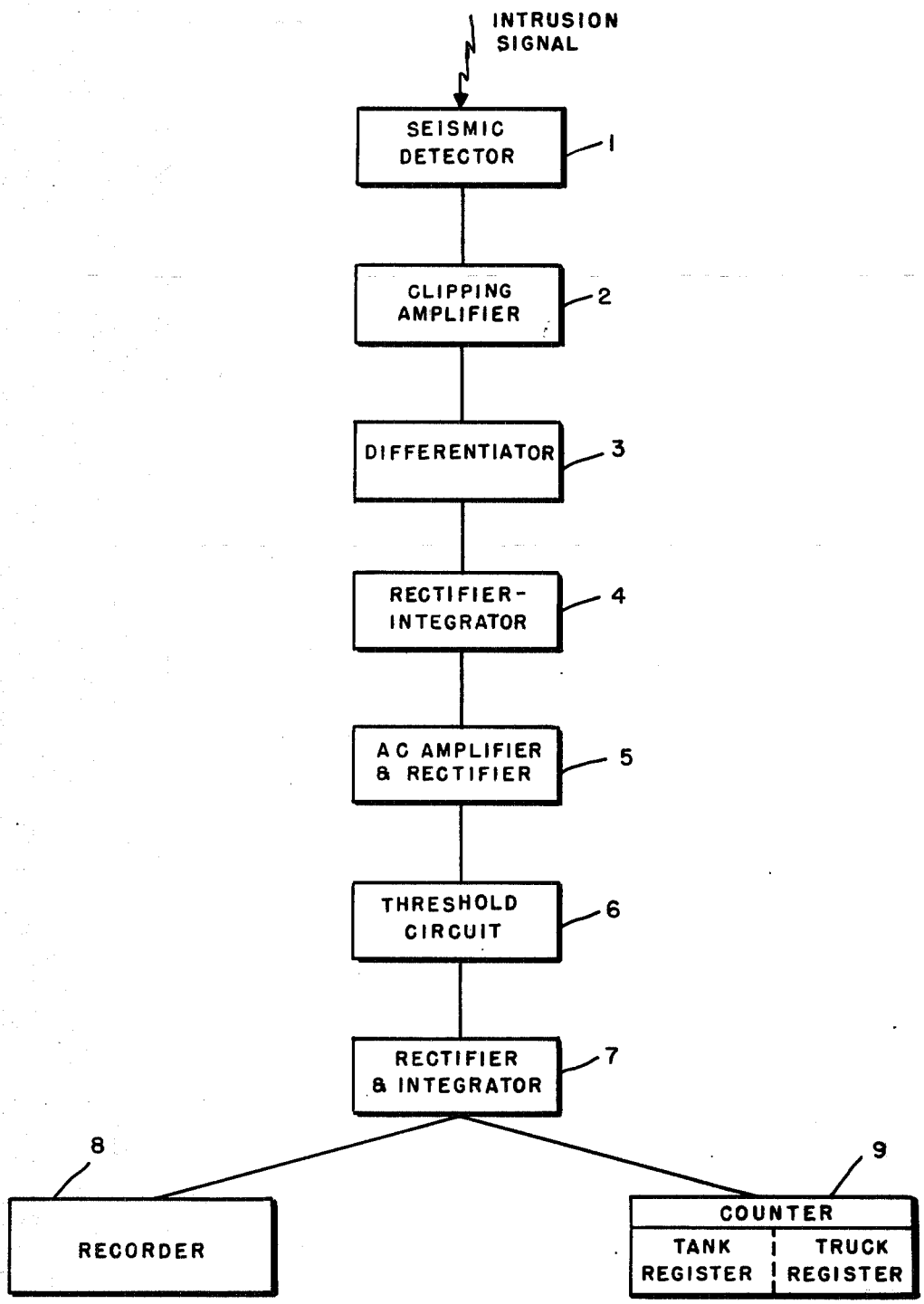
Figure 2:
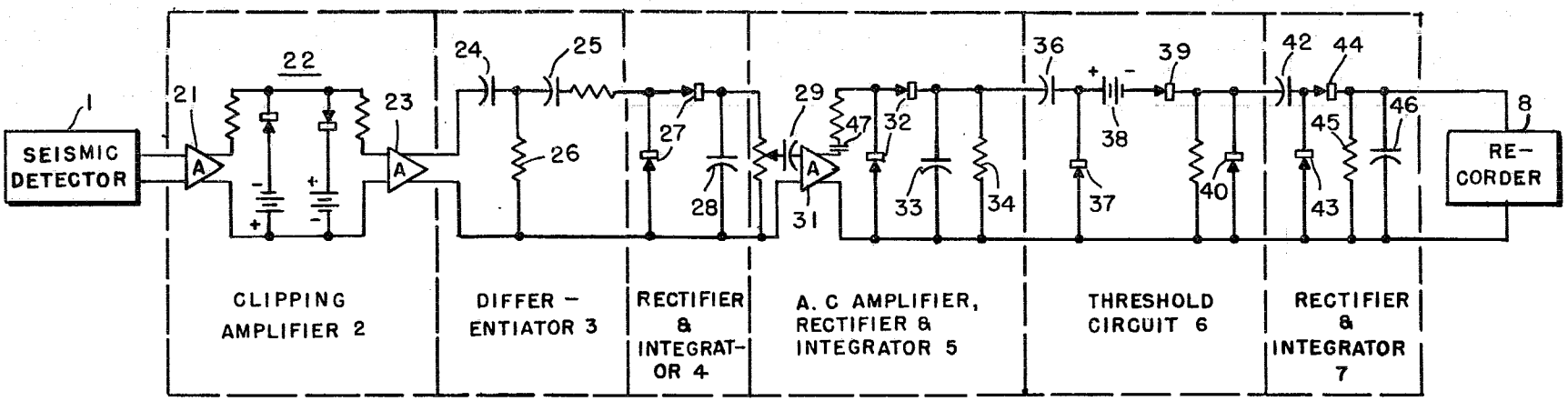

The nature of this invention will be more fully understood from the following detailed description and by reference to the accompanying drawings, in which:

FIG. 1 is a block circuit diagram showing one embodiment of a traffic identifier in accordance with our invention; and FIG. 2 is a schematic diagram in further detail of portions of FIG. 1.

In the embodiment shown, the traffic identifier comprises a seismic detector 1 for picking up the intrusion vibration signal from an approaching vehicle and for converting it into a corresponding electrical signal, referred to herein as the signature of the moving vehicle. The remaining components of our embodiment will process this signature into an electrical parameter which is proportional to the degree of randomness of the frequency of the signature.

This function is broadly accomplished by a frequency counter, by a frequency fluctuation meter and by a vehicle-type discrimination threshold circuit.

As shown in FIG. 1, the frequency counter comprises a clipping amplifier 2, a differentiator 3 and a rectifier-integrator 4 which successively follow detector 1.

Seismic detector or geophone 1 is placed near a highway on which the vehicles of interest may pass. It responds primarily to vibrations through the adjacent ground, rather than acoustic, or air-transmitted vibrations, to produce electrical signals, in this instance the so-called signatures of the passing vehicles.

Clipping amplifier 2, shown in greater detail in FIG. 2 as consisting of amplifiers 21 and 23 interconnected by clipper 22, transforms the complex signature from detector 1 into a rectangular wave having the frequency of the strongest signal component present. Capacitors 24 and 25 and resistor 26 of differentiator 3 then change the rectangular-wave into a series of alternate positive and negative voltage spikes. The following half-wave voltage-doubler rectifiers 27 and capacitor 28 of integrator circuit 4 function as a frequency meter for these spikes. The DC component of the rectified voltage across integrator 4 is then proportional to the frequency, while the AC component becomes a measure of the amount of fluctuation in the frequency of the intrusion signal from detector 1.

As was previously stated, we have found that a treaded vehicle produces small frequency variations while a tire mounted vehicle produces large frequency variations in the output signal of the frequency counter 4. Since the method of our invention utilizes the magnitude of the frequency deviations as the criterion for distinguishing between tanks and trucks, the DC component of the output voltage from rectifier-integrator 4, representing the average frequency of the intrusion signal, is not significant and is blocked from AC amplifier 31 by capacitor 29. The output of amplifier 31 is rectified by voltage doubler 32 and integrated by capacitor 33, shunted by resistor 34. This network serves as the principal portion of the above-mentioned frequency fluctuation meter.

The magnitude of the rectified AC voltage across capacitor 33 at the output of network 5 is indicative of the type of vehicle passing detector 1. A large value represents a truck while a small value represents a tank. By eliminating the DC component from the output voltage of integrator 4, the sensitivity of discrimination accuracy to vehicular speed is eliminated.

Although a reading of the output voltage from rectifier 5 would in itself be indicative of the type of vehicles passing in the vicinity of detector 1, in field operation, however, it is desired to sort tanks from trucks automatically and not visually. To this end, a threshold circuit 6 consisting of capacitor 36 and diodes 37, 39 and 40 is provided to exclude all signals below a fixed level. Battery 38 represents threshold bias applied to the diodes. This circuit is required because environmental noise entering the seismic detector 1, in addition to the inherent microphonics and noise generated in the electronic components of the overall system, produce a small input voltage into threshold circuit 6, even in the absence of vehicular activity. Thus, by limiting the rectified output signal from amplifier and rectifier circuit 5 below a predetermined value, the threshold circuit 6 will pass only from the actual signals produced by moving vehicles.

The discussion of the circuit to this point would seem to indicate that, theoretically, the output of threshold circuit 6 would be large for the frequency-fluctuating truck signals and zero for the constant frequency tank signals. Actually, however, a tank signal does not have a perfectly constant frequency; instead it has occasional imperfections so as to give a non-zero output of a level appreciably below the level of truck signals, as processed by these circuits. In order to display the output of threshold circuit 6 for the purposes of making a vehicle sorting decision at any time, the threshold output may be applied to a rectifier-integrator circuit 7 made up of capacitor 42, diodes 43 and 44, and integrating capacitor 46 shunted by resistor 45, and then finally recorded on a chart recorder 8. Small signals on the chart are classified as tanks and large signals as trucks.

In practice it may be desirable to employ a dual-section vehicle counter 9 which will record the passing vehicles in a "tank register" or a "truck register," depending on the level of the signal voltage appearing at the output of threshold circuit 6. For example, the counter may include a pair of gate circuits switched by signals at one or the other of the respective levels of the discriminator (frequency fluctuation meter circuit 5) output representing trucks or tanks, the gates being responsive to pulses generated when the vehicles are at their closest point of approach to seismic detector 1. The gate to the tank register will be closed, and the gate to truck register opened, by a low level signal from the discriminator output representing a tank, while a truck signal will reverse the gates so that the pulses may be stored in the appropriate registers. Schmitt-trigger circuits may replace or follow threshold circuit 6 to separate the two levels of pulses from frequency fluctuation meter for controlling these gates. Bias for the Schmitt-trigger circuits should be set at such a level as provide the greatest vehicle sorting accuracy. Too low a bias level will make this type of circuit identify some tanks as trucks, while too high a level will cause some trucks to register as tanks.

Other suitable register circuits suggest themselves, the significant requirement being that these circuits are responsive to different input voltage levels, as in the patent to Giorso et al, U.S. Pat. No. 2,784,910.

From the foregoing description it will be readily appreciated that our invention provides a relatively simple discriminator circuit for reliably distinguishing and counting vehicular traffic, utilizing seismic detecting means to eliminate as much as possible confusing air-transmitted sounds. By adding the frequency fluctuation meter circuit 5 to the frequency meter circuit, a discrimination accuracy superior to any previously known is achieved. Many modifications may be made within the spirit and scope of the invention, and it should therefore be limited, not by the circuits shown and described, but by the scope of the appended claims.

What is claimed is:

1. In a vehicle identifying system, seismic detecting means for converting seismic signals generated by passing vehicles into electrical signals, amplifying and clipping means for converting the electrical signals into substantially rectangular waves, means for differentiating and integrating said rectangular waves, and means coupled to said differentiating and integrating means to produce voltage levels indicative of passing vehicles of differing tread characteristics.

2. A vehicle identifying system in accordance with claim 1 wherein said voltage-level producing means includes alternating-current amplifier and rectifier means to produce signals dependent only on the a.c. characteristics of the output from said differentiating and integrating means.

3. A vehicle identifying system in accordance with claim 2 wherein said voltage-level producing means further includes a rectifier and integrator circuit coupled to said a.c. amplifier and rectifier means to produce said voltage levels.

4. The vehicle identifying system of claim 3 wherein a threshold circuit is interposed between said a.c. amplifier and rectifier means and said rectifier-integrator circuit to suppress noise signals in said system.

5. The vehicle identifying system of claim 4 wherein indicating means is coupled to said rectifier-integrator circuit to visually indicate the character of passing vehicles.

6. The vehicle identifying means of claim 5 wherein said identifying means includes means for recording the respective types of vehicles passing the seismic detecting means.

7. A vehicle identifying circuit comprising: a seismic detector, a clipper and an amplifier, a differentiator, a rectifier and an integrator coupled in sequence and having an output; an a.c. amplifier coupled to said output; and rectifier and integrator means coupled to said a.c. amplifier to produce voltage signals indicative of the tread characteristics of the vehicles passing said detector.

8. The vehicle identifying circuit of claim 7 wherein means is coupled to said rectifier and integrator means to indicate the number and type of vehicles detected.

9. The vehicle identifying circuit of claim 8 wherein a threshold circuit is interposed between said a.c. amplifier and said rectifier and integrator means to minimize spurious noise signals in said vehicle identifying circuit.

10. A vehicle identifying circuit comprising: means for detecting seismic vibrations created by passing vehicles and converting them into electrical impulses; frequency-sensing circuit means coupled to said detecting means for producing electrical signals in accordance with the frequency characteristics of said impulses, said frequency-sensing circuit means comprising an amplifier, a clipper circuit, a differentiator circuit, a rectifier and an integrator coupled in sequence to produce said electrical signals; and vehicle discriminating circuit means coupled to said frequency-sensing means to convert said signals into output pulses having voltage levels indicative of the character of the suspension system of the passing vehicle.

11. The vehicle identifying circuit of claim 10 wherein said vehicle-discriminating circuit means includes an a.c. amplifier coupled to said integrator, a rectifier and a second integrator coupled in sequence to produce said output pulses.

12. The vehicle identifying circuit of claim 11 wherein an indicating means is coupled to said second integrator to produce a visual record of the vehicles passing said seismic detecting means.

13. The vehicle identifying circuit of claim 12 wherein a threshold circuit means is interposed between said second integrator and said indicating means to reduce the effect of spurious signals in said vehicle identifying circuit.

* * * * *